US010640346B2

(12) United States Patent
Ijadi-Maghsoodi et al.

(10) Patent No.: US 10,640,346 B2
(45) Date of Patent: May 5, 2020

(54) AUTOMATIC REVERSING SCREW MECHANISM FOR CABLE WINDING

(71) Applicant: Goodrich Corporation, Charlotte, NC (US)

(72) Inventors: Bejan Ijadi-Maghsoodi, Diamond Bar, CA (US); Paul Maker, Wrentham, MA (US); Zachary Limas, Diamond Bar, CA (US)

(73) Assignee: Goodrich Corporation, Charlotte, NC (US)

( * ) Notice: Subject to any disclaimer, the term of this patent is extended or adjusted under 35 U.S.C. 154(b) by 203 days.

(21) Appl. No.: 15/910,807

(22) Filed: Mar. 2, 2018

(65) Prior Publication Data

US 2018/0251352 A1 Sep. 6, 2018

Related U.S. Application Data

(60) Provisional application No. 62/466,903, filed on Mar. 3, 2017.

(51) Int. Cl.
*B66D 1/39* (2006.01)
*B65H 75/44* (2006.01)
(Continued)

(52) U.S. Cl.
CPC ..... *B66D 1/39* (2013.01); *A62B 1/18* (2013.01); *B65H 75/4407* (2013.01); *B66D 1/14* (2013.01); *B66D 1/28* (2013.01); *B66D 1/60* (2013.01)

(58) Field of Classification Search
CPC .. A62B 1/18; B65H 75/4407; B65H 75/4413; B66D 1/20; B66D 1/22; B66D 1/38; B66D 1/39; B66D 1/60
See application file for complete search history.

(56) References Cited

U.S. PATENT DOCUMENTS 1,472,847 A * 11/1923 McGann ..... B65H 54/2812 242/482.9
1,918,587 A * 7/1933 Bryant ..... B65H 54/2812 74/58

(Continued)

FOREIGN PATENT DOCUMENTS

| | | | |
|---|---|---|---|
| CN | 102502442 | B | 6/2012 |
| DE | 102012013527 | A1 | 1/2014 |
| DE | 204980988 | U | 1/2016 |

OTHER PUBLICATIONS

Extended European Search Report for EP Application No. 18155147.4, dated Jul. 23, 2018, 7 pages.

*Primary Examiner* — Emmanuel M Marcelo
(74) *Attorney, Agent, or Firm* — Kinney & Lange, P.A.

(57) ABSTRACT

A level wind mechanism includes a first screw and a second screw extending through a block. A shoe is disposed within the block between the first screw and the second screw. The shoe includes a first follower for engaging with and being driven by a thread of the first screw and a second follower for engaging with and being driven by a thread of the second screw. Each thread includes cams at the terminal ends of the thread for causing the shoe to disengage from that thread and to shift to engaging the other thread. In this way, the first screw and the second screw cause the shoe, and thus the block, to translate relative to the first screw and the second screw.

16 Claims, 9 Drawing Sheets

(51) Int. Cl.

| | |
|---|---|
| ***A62B 1/18*** | (2006.01) |
| ***B66D 1/60*** | (2006.01) |
| ***B66D 1/14*** | (2006.01) |
| ***B66D 1/28*** | (2006.01) |

(56) References Cited

U.S. PATENT DOCUMENTS

| | | | | | |
|---|---|---|---|---|---|
| 2,324,329 | A * | 7/1943 | Shoffner | B66D 1/02 | 242/483.5 |
| 2,421,269 | A * | 5/1947 | Joyce | B66D 1/36 | 242/397.3 |
| 2,437,725 | A * | 3/1948 | Conner | B65H 54/2812 | 242/483.1 |
| 2,757,883 | A * | 8/1956 | Schlang | B66D 1/36 | 242/483.1 |
| 3,061,237 | A * | 10/1962 | Carter | B65H 54/12 | 242/483.1 |
| 3,309,066 | A * | 3/1967 | Carlson | B66D 1/22 | 254/268 |
| 3,937,420 | A * | 2/1976 | Galis | B65H 54/28 | 242/483.1 |
| 4,159,813 | A * | 7/1979 | Yale | B65H 54/2866 | 242/480.8 |
| 4,645,135 | A * | 2/1987 | Morris | B65H 54/28 | 242/471 |
| 5,141,172 | A * | 8/1992 | Holcomb | B65H 54/2812 | 242/483.5 |
| 10,093,522 | B1 * | 10/2018 | Baugh | B66D 1/36 | |
| 2017/0166422 | A1 * | 6/2017 | Mahnken | A62B 35/00 | |

* cited by examiner

AUTOMATIC REVERSING SCREW MECHANISM FOR CABLE WINDING

CROSS-REFERENCE TO RELATED APPLICATION(S)

This application claims the benefit of U.S. Provisional Application No. 62/466,903 filed Mar. 3, 2017 for "AUTOMATIC REVERSING SCREW MECHANISM FOR CABLE WINDING".

BACKGROUND

This disclosure relates generally to hoists. More particularly, this disclosure relates to translating body rescue hoists for aircraft.

Rescue hoists deploy and retrieve a cable from a cable drum to hoist persons or cargo, and the rescue hoist may be mounted to an aircraft, such as a helicopter. The rescue hoist includes a drum off of which the cable is deployed. The cable drum rotates to spool or unspool the cable from the cable drum, with one end of the cable attached to the cable drum and the other end, which can include a hook or other device, deployed during operation. The cable should be levelly wound onto the cable drum to prevent fouling of the cable and to prevent the cable from experiencing extra strain. To levelly wind the cable onto the cable drum, either the cable drum or a payout block translates during cable winding and unwinding to ensure that the cable is properly aligned on the cable drum. To ensure that the cable is levelly wound either the cable drum or the payout block is attached to and follows along a level wind mechanism, which is typically a dual-threaded screw such as a diamond screw, yankee screw, or reversing screw. Dual-threaded screws include inherently sharp features where the grooves intersect, which can fracture due to vibration leading to the follower prematurely reversing direction, causing a cable miswrap on the cable drum.

SUMMARY

According to an aspect of the disclosure, a level wind mechanism includes a first screw, a second screw, a block through which the first screw and the second screw extend, and a shoe retained within the block between the first screw and the second screw. The first screw has a first driven end, a first distal end, and a first thread. The second screw has a second driven end, a second distal end, and a second thread. The shoe has a first follower extending from a first end of the shoe and a second follower extending from a second end of the shoe. The first follower is configured to engage with and be driven by the first thread and the second follower is configured to engage with and be driven by the second thread.

According to another aspect of the disclosure, a rescue hoist includes a cable drum rotatable about a cable drum axis, a linear bearing extending through and supporting the cable drum and configured to cause the cable drum to rotate about the cable drum axis, a stationary frame supporting the linear bearing, and a level wind mechanism configured to cause the cable drum to translate along the cable drum axis. The level wind mechanism includes a first screw, a second screw, a block through which the first screw and the second screw extend, and a shoe retained within the block between the first screw and the second screw. The first screw has a first driven end, a first distal end, and a first thread. The second screw has a second driven end, a second distal end, and a second thread. The block is mounted on an inner surface of the cable drum. The shoe has a first follower extending from a first end of the shoe and a second follower extending from a second end of the shoe. The first follower is configured to engage with and be driven by the first thread and the second follower is configured to engage with and be driven by the second thread.

DETAILED DESCRIPTION

Figure 1A:
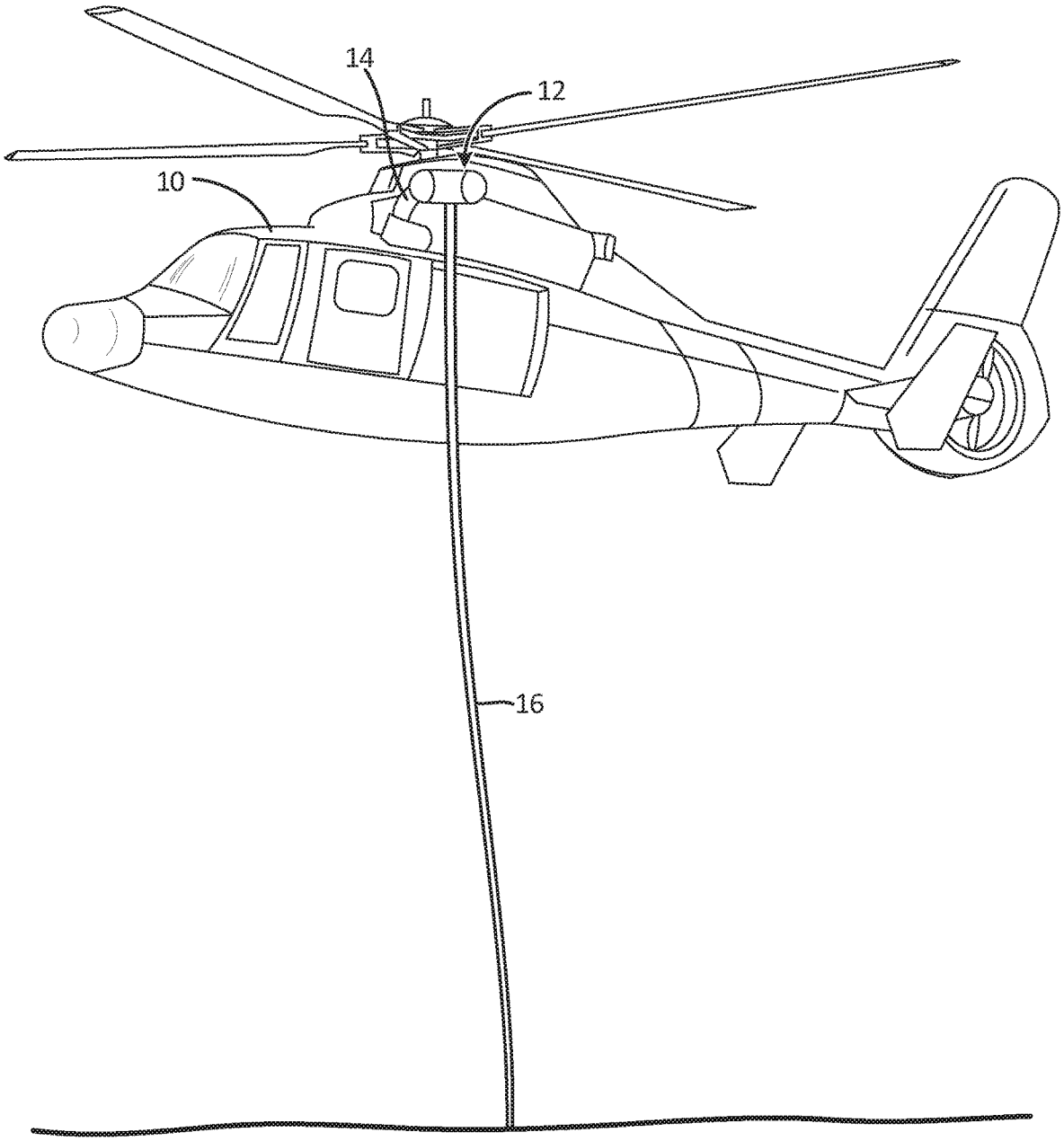
FIG. 1A is an elevation view of an aircraft and rescue hoist.
Figure 1B:
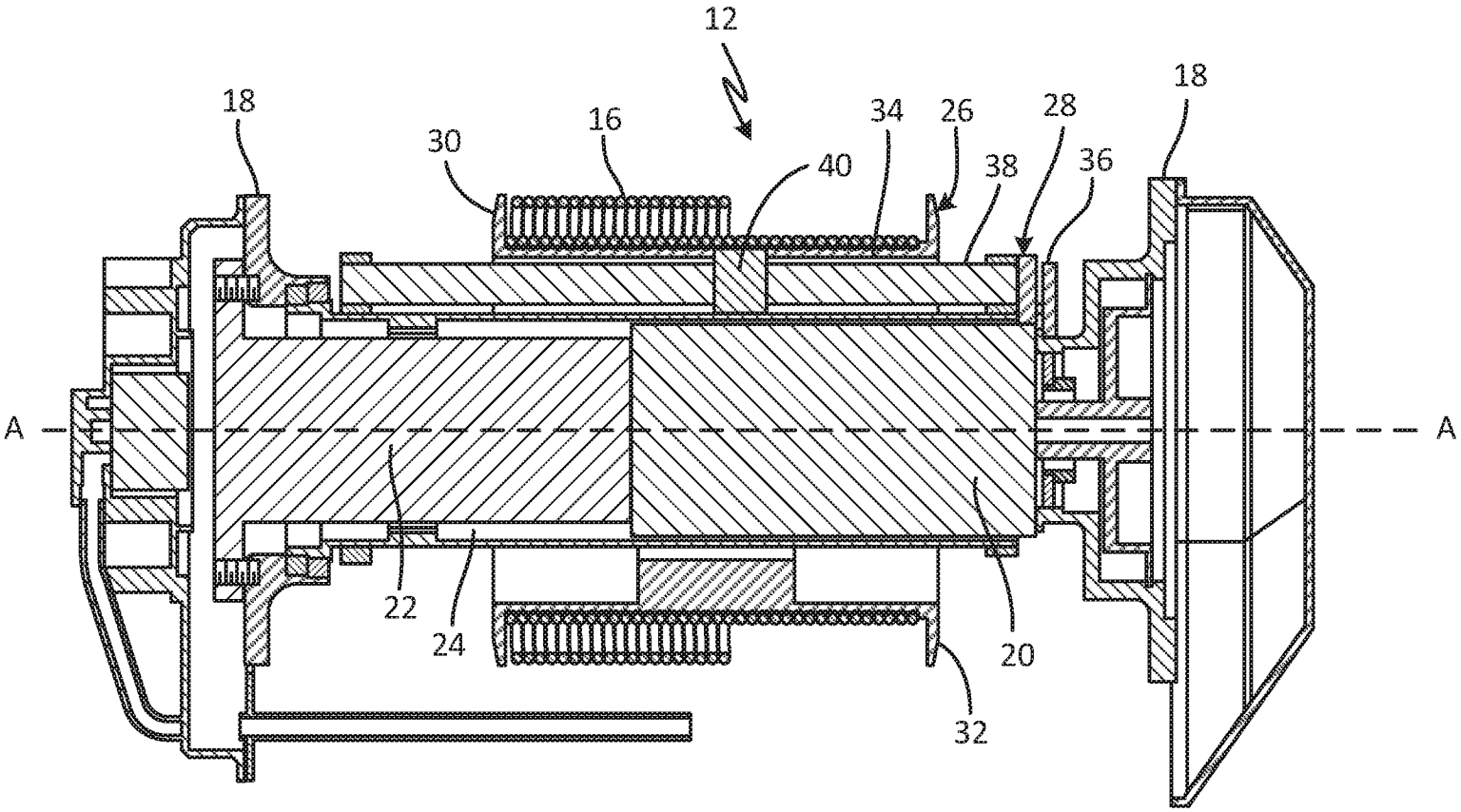
FIG. 1B is a cross-sectional view of a rescue hoist.

FIG. 1A is an elevation view of aircraft 10 and rescue hoist 12. FIG. 1B is a cross-sectional view of rescue hoist 12. FIGS. 1A and 1B will be discussed together. Rescue hoist 12 is mounted to aircraft 10 by support 14, and cable 16 extends from rescue hoist 12. Rescue hoist 12 includes frame 18, motor 20, drive train 22, linear bearing 24, cable drum 26, and level wind mechanism 28. Cable drum 26 includes first flange 30, second flange 32, and barrel 34. Barrel 34 extends between and connects first flange 30 and second flange 32. Level wind mechanism 28 includes main drive gear 36, screws 38, and traveling block 40.

Rescue hoist 12 is mounted to aircraft 10 by support 14. Cable 16 extends from rescue hoist 12 and is configured to raise and lower objects to and from aircraft 10. Linear bearing 24 is rotatably mounted to frame 18. Motor 20 extends from frame 18 and is disposed within linear bearing 24. Drive train 22 is connected to motor 20 and linear bearing 24, and drive train 22 is configured to transmit rotational power from motor 20 to linear bearing 24. Cable drum 26 is mounted to linear bearing 24. Level wind mechanism 28 is also mounted to linear bearing 24 and extends through cable drum 26. Cable 16 wraps around barrel 34 of cable drum 26 and is retained between first flange 30 and second flange 32.

During operation, motor 20 is activated and provides rotational power to drive train 22. Drive train 22 is a gear reduction drive, and drive train 22 outputs rotational power to linear bearing 24, thereby causing linear bearing 24 to rotate about cable drum axis A-A. In one embodiment, linear bearing 24 is a ball spline bearing, and as such linear bearing 24 is capable of transmitting torque to cable drum 26 to thereby cause cable drum to rotate about cable drum axis A-A to spool cable 16 onto cable drum 26 or unspool cable 16 from cable drum 26.

Level wind mechanism 28 is mounted to linear bearing 24 such that level wind mechanism 28 rotates about cable drum axis A-A with linear bearing 24. Main drive gear 36 is attached to screw 38 and is meshed with teeth on a housing of motor 20. Because the housing of motor 20 remains stationary as linear bearing 24 rotates, rotating linear bearing 24 causes main drive gear 36 to rotate due to main drive gear 36 meshing with the teeth on the housing of motor 20. Main drive gear 36 transmits the resulting rotational power to screw 38, thereby causing screw 38 to rotate. Traveling block 40 is mounted to cable drum 26 and tracks along screw 38 as screw 38 rotates, thereby causing cable drum 26 to translate along cable drum axis A-A due to the connection of traveling block 40 and cable drum 26. Cable drum 26 translates along cable drum axis A-A to allow cable 16 to be paid out through a single point on rescue hoist 12.

While rescue hoist 12 is described as including cable drum 26 that translates along cable drum axis A-A, it is understood that cable drum 26 can be fixed such that cable drum 26 does not translate along cable drum axis A-A. Where cable drum 26 does not translate, rescue hoist includes a translating payout point. Drive train 22 can be directly meshed with barrel 34 of cable drum 26 to cause cable drum 26 to rotate about cable drum axis A-A. Level wind mechanism 28 is meshed with a payout mechanism through which cable 16 extends. Level wind mechanism 28 rotates with cable drum 26 and causes a follower to translate relative to cable drum 26. Cable 16 is paid out and retrieved through a follower. The follower translates relative to cable drum 26 to ensure that cable 16 is levelly wound onto and off of cable drum 26. To ensure level winding of cable 16, the follower is connected to screw 38 of level wind mechanism 28. While level wind mechanism 28 is shown extending through cable drum 26, it is understood that level wind mechanism 28 can also be mounted outside of cable drum 26.

Figure 2:
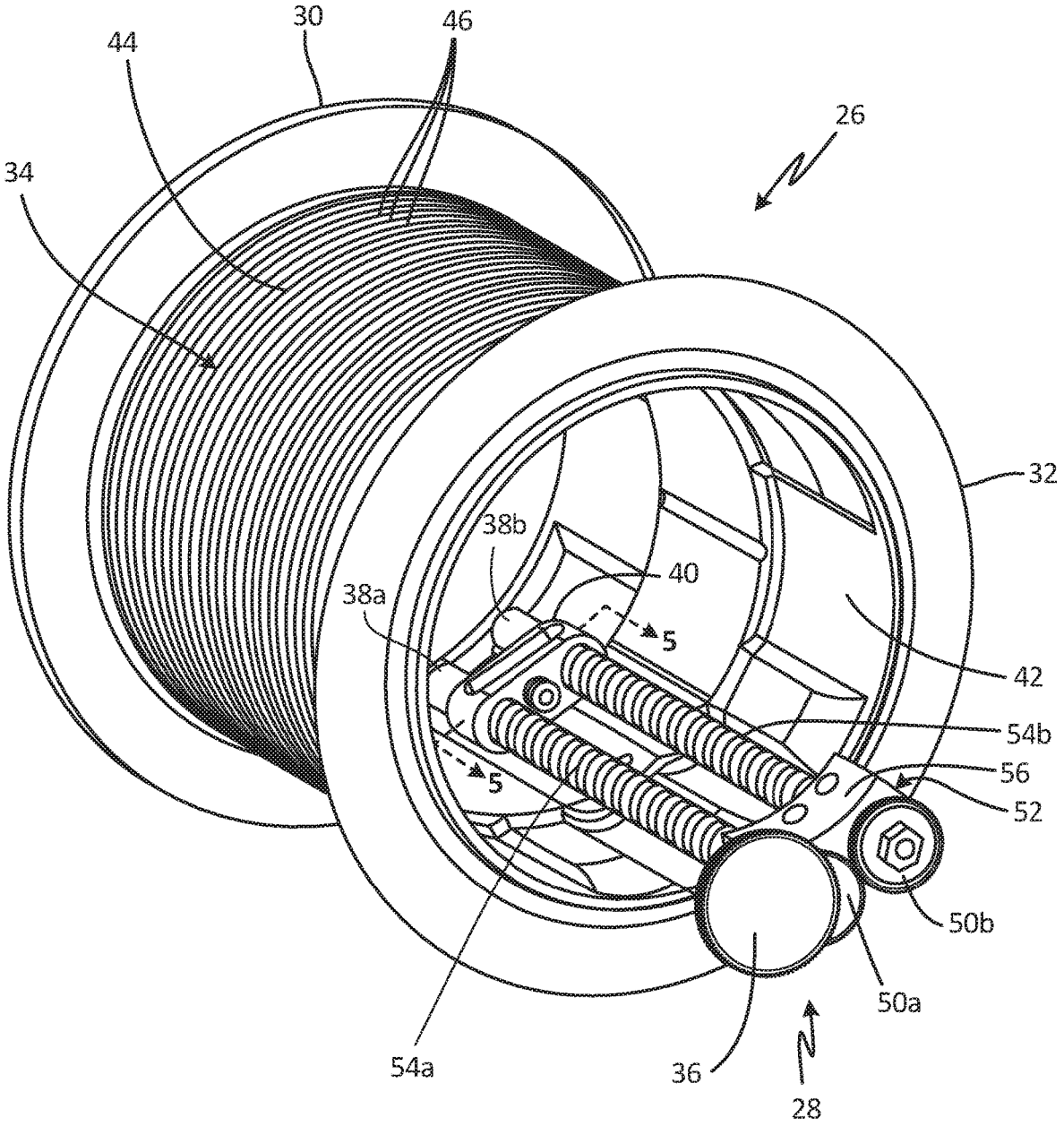
FIG. 2 is a perspective view of a cable drum and level wind mechanism.

FIG. 2 is a perspective view of cable drum 26 and level wind mechanism 28. Cable drum 26 includes first flange 30, second flange 32, and barrel 34. Barrel 34 includes inner surface 42 and outer surface 44. Outer surface 44 includes grooves 46. Level wind mechanism 28 includes main drive gear 36, first screw 38*a*, second screw 38*b*, traveling block 40, shoe 48 (shown in FIGS. 3A-5B), first drive gear 50*a*, second drive gear 50*b*, and mount 52. First screw 38*a* includes first thread 54*a* and second screw 38*b* includes second thread 54*b*. Mount 52 includes mounting flange 56.

Barrel 34 extends between and connects first flange 30 and second flange 32. Grooves 46 extend about outer surface 44 of barrel 34 and are configured to maintain a position of cable 16 (shown in FIG. 1) on barrel 34. Traveling block 40 is connected to inner surface 42 of barrel 34. Mount 52 is attached to linear bearing 24 (shown in FIG. 1B) by mounting flange 56 and as such, mount 52 rotates about cable drum axis A-A along with linear bearing 24. Linear bearing 24 extends through cable drum 26 and transmits torque to cable drum 26, thereby causing cable drum 26 to rotate about cable drum axis A-A. For example, linear bearing 24 can be a ball spline bearing.

First screw 38*a* extends through mount 52 and is connected to first drive gear 50*a*. Similarly, second screw 38*b* extends through mount 52 and is connected to second drive gear 50*b*. First thread 54*a* extends along first screw 38*a* and second thread 54*b* extends along second screw 38*b*. In one embodiment, first thread 54*a* and second thread 54*b* have an Acme thread form, but it is understood that first thread 54*a* and second thread 54*b* can take any desired form, such as a trapezoidal thread form other than an acme thread, a square thread form, or any other desired thread form. In one embodiment, first screw 38*a* is identical to second screw 38*b*. As such, in one embodiment first thread 54*a* is a right-hand thread and second thread 54*b* is also a right-hand thread. In another embodiment, first thread 54*a* is a left-hand thread and second thread 54*b* is also a left-hand thread.

Main drive gear 36 is shown as engaging first drive gear 50*a*, but it is understood that main drive gear 36 can engage first drive gear 50*a*, second drive gear 50*b*, or both. Main drive gear 36 can also engage and drive an intermediate gear to transmit power to first drive gear 50*a* and second drive gear 50*b*. First drive gear 50*a* meshes with second drive gear 50*b*. Directly meshing first drive gear 50*a* and second drive gear 50*b* cause first drive gear 50*a* and second drive gear 50*b* to rotate in opposite directions and to rotate at the same speed, as first drive gear 50*a* and second drive gear 50*b* have the same number of gear teeth in one embodiment. It is understood, however, that an intermediate gear can be positioned between first drive gear 50*a* and second drive gear 50*b* to transmit power therebetween and cause first drive gear 50*a* and second drive gear 50*b* to rotate in the same direction. Main drive gear 36 can also be positioned between first drive gear 50*a* and second drive gear 50*b* to engage both first drive gear 50*a* and second drive gear 50*b* and to cause first drive gear 50*a* and second drive gear 50*b* to rotate in the same direction. Where first screw 38*a* and second screw 38*b* rotate in the same direction, a handedness of first thread 54*a* differs from a handedness of second thread 54*b*. The differing handedness allows first thread 54*a* to drive an object in a first direction and second thread 54*b* to drive an object in a second direction opposite the first direction while both first screw 38*a* and second screw 38*b* rotate in the same direction.

Traveling block 40 is disposed on and attached to inner surface 42 of barrel 34. First screw 38*a* extends from first drive gear 50*a* and through traveling block 40. Second screw 38*b* extends from second drive gear 50*b* and through traveling block 40. A shoe (shown in FIGS. 3A-3C and 5A-7) is disposed within traveling block 40, and the shoe is configured to shuttle between and engage first thread 54*a* and second thread 54*b*. First screw 38*a* and second screw 38*b* drive the shoe axially along cable drum axis A-A in a reciprocating manner. The shoe transmits driving force from first screw 38*a* and second screw 38*b* to traveling block 40, and traveling block 40 transmits the driving force to cable drum 26, thereby driving cable drum 26 in a reciprocating manner along cable drum axis A-A. Cable drum 26 translates along cable drum axis A-A to ensure that cable 16 is levelly wound onto outer surface 44 of barrel 34. Translating cable drum 26 allows for cable 16 to be paid out from a single point, reducing any stresses that can be caused due to large fleet angles, thereby allowing side loads to be transmitted directly to the frame of the rescue hoist and to the airframe of the aircraft, reducing stress on the components of rescue hoist 12.

During operation motor 20 (shown in FIG. 1B) provides power, either directly or indirectly, such as through drive train 22 (shown in FIG. 1B) or other intermediate transmission, to linear bearing 24 and main drive gear 36. As linear bearing 24 rotates, cable drum 26 and level wind mechanism 28 simultaneously rotate about cable drum axis A-A. The rotation of main drive gear 36 powers first drive gear 50*a* and second drive gear 50*b*, thereby causing first screw 38*a* and second screw 38*b* to rotate. Due to the direct connection of first drive gear 50*a* and second drive gear 50*b*, first screw 38*a* rotates opposite second screw 38*b*. Where the shoe is initially engaged with first thread 54*a*, the shoe is driven along a length of first thread 54*a* due to the connection of the shoe and first thread 54*a*. With the shoe captured within traveling block 40, the shoe transmits driving forces from first screw 38*a* to traveling block 40, and traveling block 40 transmits the driving forces to cable drum 26. As such, cable drum 26 shifts along cable drum axis A-A due to the connection of cable drum 26 to level wind mechanism 28 through traveling block 40.

When the shoe reaches an end of first thread 54*a*, the shoe translates over and engages second thread 54*b* of second screw 38*b*. Because second screw 38*b* rotates opposite first screw 38*a*, second screw 38*b* drives the shoe in an opposite direction than first screw 38*a*. As such, second screw 38*b* drives cable drum 26 back along cable drum axis A-A. When the shoe reaches an end of second thread 54*b*, the shoe translates over and engages first thread 54*a*. In this way, the shoe and thus cable drum 26 is driven in a reciprocating manner by first screw 38*a* and second screw 38*b*. It is understood that both first screw 38*a* and second screw 38*b* can drive cable drum 26 in either direction along cable drum axis A-A depending on the direction of rotation of main drive gear 36, and thus of first drive gear 50*a* and second drive gear 50*b*. For example, where first screw 38*a* rotates in a clockwise direction and second screw 38*b* rotates in a counterclockwise direction to unspool cable 16 from cable drum 26, first screw 38*a* will rotate in the counterclockwise direction and second screw 38*b* will rotate in the clockwise direction to spool cable 16 onto cable drum 26. As such, level wind mechanism 28 ensures that cable 16 is levelly wound onto cable drum 26

Translating cable drum 26 along cable drum axis A-A ensures that cable 16 is levelly wound onto cable drum 26. Cable drum 26 displaces axially along cable drum axis A-A to ensure that cable 16 is aligned with a sheave (not shown) as cable 16 unspools from or spools onto cable drum 26. Levelly winding cable 16 helps ensure that cable 16 is properly wound onto and off of cable drum 26.

Figure 3A:
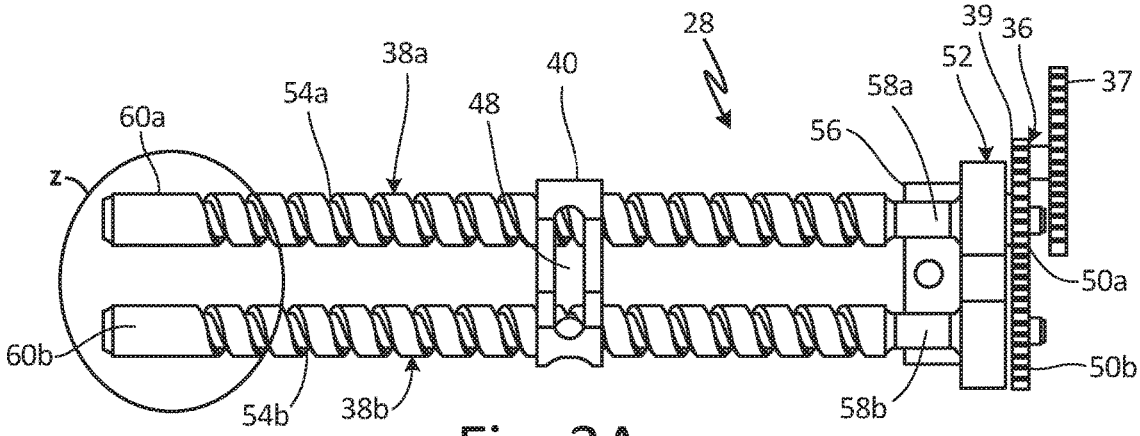
FIG. 3A is an elevation view of a level wind mechanism.
Figure 3B:
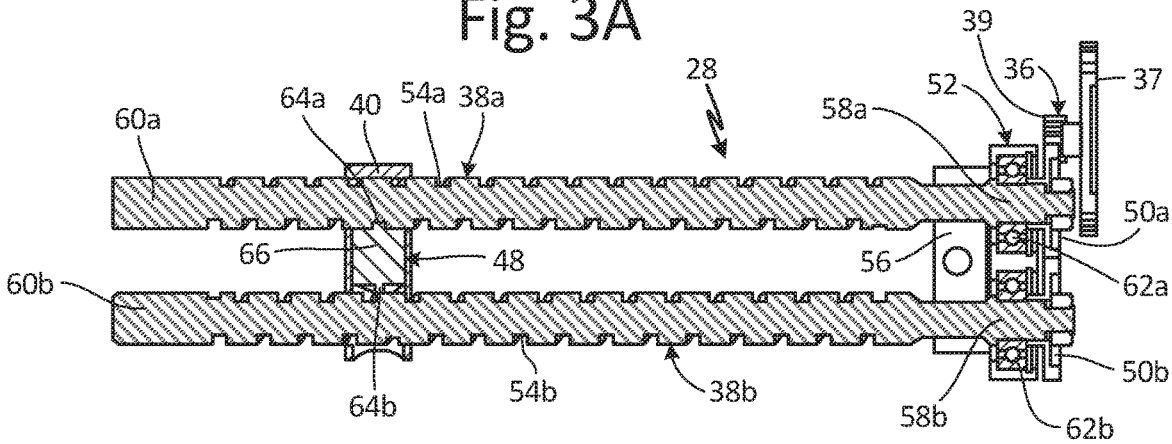
FIG. 3B is a cross-sectional view of the level wind mechanism of FIG. 3A showing a shoe in a first position.
Figure 3C:
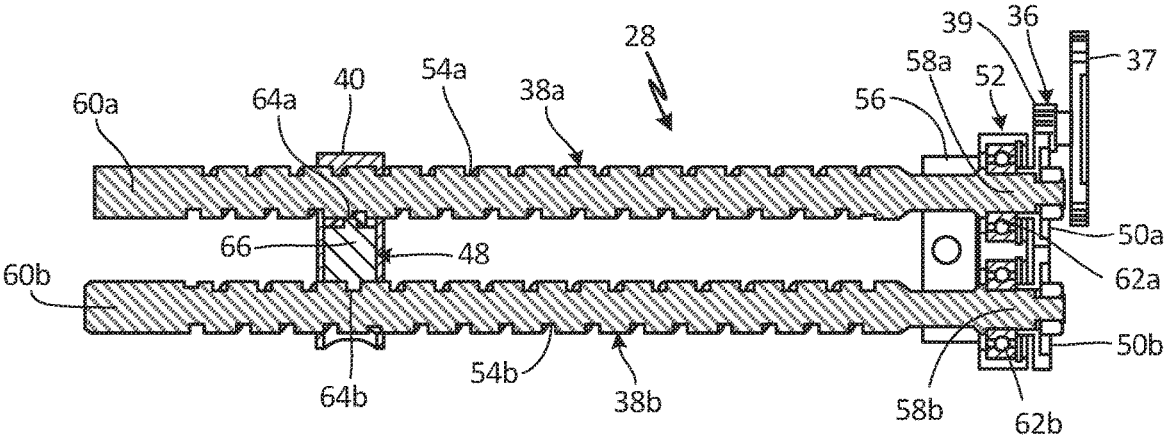
FIG. 3C is a cross-sectional view of the level wind mechanism of FIG. 3A showing a shoe in a second position.

FIG. 3A is an elevation view of level wind mechanism 28. FIG. 3B is a cross-sectional view of level wind mechanism 28 showing shoe 48 in a first position. FIG. 3C is a cross-sectional view of level wind mechanism 28 showing shoe 48 in a second position. FIGS. 3A-3C will be discussed together. Level wind mechanism 28 includes main drive gear 36, first screw 38*a*, second screw 38*b*, traveling block 40, shoe 48, first drive gear 50*a*, second drive gear 50*b*, and mount 52. First screw 38*a* includes first thread 54*a*, driven end 58*a*, and distal end 60*a*. Second screw 38*b* includes second thread 54*b*, driven end 58*b*, and distal end 60*b*. Mount 52 includes mounting flange 56, bearing 62*a*, and bearing 62*b*. Shoe 48 includes first follower 64*a*, second follower 64*b*, and shoe body 66. Main drive gear 36 includes input gear 37 and output gear 39.

First screw 38*a* and second screw 38*b* extend through and are supported by mount 52. Driven end 58*a* of first screw 38*a* extends through mount 52 and is connected to first drive gear 50*a*. Driven end 58*a* is rotatably supported within mount 52 by bearing 62*a*. First thread 54*a* extends about first screw 38*a* between driven end 58*a* and distal end 60*a*. Driven end 58*b* of second screw 38*b* extends through mount 52 and is connected to second drive gear 50*b*. Driven end 58*b* is rotatably supported within mount 52 by bearing 62*b*. Second thread 54*b* extends about second screw 38*b* between driven end 58*b* and distal end 60*b*. Main drive gear 36 provides rotational power to first drive gear 50*a* and second drive gear 50*b*. Output gear 39 is meshed with one or both of first drive gear 50*a* and second drive gear 50*b*. Input gear 37 is meshed with teeth on frame 18 (shown in FIG. 1B), such that rotating level wind mechanism 28 about cable drum axis A-A with linear bearing 24 (shown in FIG. 1B) causes main drive gear 36 to rotate.

First thread 54*a* can be a right-hand thread or a left-hand thread. Similarly, second thread 54*b* can be a right-hand thread or a left-hand thread. In an embodiment where first thread 54*a* is a right-hand thread, second thread 54*b* is also a right-hand thread. With both first thread 54*a* and second thread 54*b* having the same handedness, first screw 38*a* is identical to second screw 38*b*, thereby simplifying both the manufacturing and assembly process and reducing the material costs associated with level wind mechanism 28.

Shoe 48 is disposed within traveling block 40 between first screw 38*a* and second screw 38*b*. First follower 64*a* extends from an end of shoe body 66, and second follower 64*b* extends from an end of shoe body 66 opposite first follower 64*a*. First follower 64*a* is configured to engage with and track along first thread 54*a* as first screw 38*a* rotates. Similarly, second follower 64*b* is configured to engage with and track along second thread 54*b* as second screw 38*b* rotates. In one embodiment, shoe body 66 is cylindrical, thereby allowing shoe 48 to rotate relative to traveling block 40. Enabling shoe 48 to rotate relative to traveling block 40 ensures that first follower 64*a* is properly aligned with first thread 54*a* when shoe 48 translates to engage first thread 54*a*, and ensures that second follower 64*b* is properly aligned with second thread 54*b* when shoe 48 translates to engage second thread 54*b*.

During operation, main drive gear 36 provides rotational power to first drive gear 50*a* and second drive gear 50*b*. In one embodiment, first drive gear 50*a* and second drive gear 50*b* are identical, such that first drive gear 50*a* and second drive gear 50*b* have the same rotational speed. Because the teeth of first drive gear 50*a* are intermeshed with the teeth of second drive gear 50*b*, first drive gear 50*a* and second drive gear 50*b* rotate in opposite directions. First screw 38*a* thus rotates opposite second screw 38*b*.

In FIG. 3B, first follower 64*a* is engaged with first thread 54*a*. As first screw 38*a* rotates, first follower 64*a* tracks along first thread 54*a* thereby causing shoe 48 to displace axially along first screw 38*a*. Because shoe 48 is retained within traveling block 40, displacing shoe 48 relative to first screw 38 also causes traveling block 40 to displace relative to first screw 38, thereby causing cable drum 26 to translate relative to level wind mechanism 28. When first follower 64*a* reaches an end of first thread 54*a*, first thread 54*a* pushes first follower 64*a* out of first thread 54*a*, thereby driving shoe 48 towards second screw 38*b*. Shoe 48 translates within traveling block 40 and second follower 64*b* engages second thread 54*b*.

In FIG. 3C, second follower 64*b* is engaged with second thread 54*b*. As second screw 38*b* rotates, second follower 64*b* tracks along second thread 54*b* thereby causing shoe 48 to displace axially along second screw 38*b*. Because shoe 48 is retained within traveling block 40, displacing shoe 48 relative to second screw 38*b* causes traveling block 40 to displace relative to second screw 38*b*, thereby causing cable drum 26 to translate relative to level wind mechanism 28. When second follower 64*b* reaches an end of second thread 54*b*, second thread 54*b* pushed second follower 64*b* out of second thread 54*b*, thereby driving shoe 48 towards first screw 38*a*.

First screw 38*a* and second screw 38*b* drive shoe 48 in opposite axial directions due to first screw 38*a* rotating in an opposite direction from second screw 38*b*. It is understood, however, that each of first screw 38*a* and second screw 38*b* can displace cable drum 26 in either axial direction, depending on the rotational input from main drive gear 36. Main drive gear 36 rotates in a first rotational direction when unspooling cable 16 from cable drum 26 and main drive gear 36 rotates in a second rotational direction when spooling cable 16 back onto the cable drum 26. In this way, level wind mechanism 28 ensures that cable 16 is levelly wound and unwound from cable drum 26.

Level wind mechanism 28 provides significant advantages. In one embodiment, first screw 38*a* and second screw 38*b* are identical and mounted to rotate in opposite directions. Having first screw 38*a* identical to second screw 38*b* simplifies the manufacturing process, as only a single part number and configuration is required to supply both first screw 38*a* and second screw 38*b*. In addition, each of first thread 54*a* and second thread 54*b* is the only thread on first screw 38*a* and second screw 38*b*, respectively. As such, neither first screw 38*a* nor second screw 38*b* is a self-reversing screw that includes both right-hand and left-hand threads. By eliminating self-reversing screws from level wind mechanism 28, sharp points, where the differing threads intersect, are eliminated Eliminating the sharp points increases the resiliency and lifespan of level wind mechanism 28.

Figure 4:
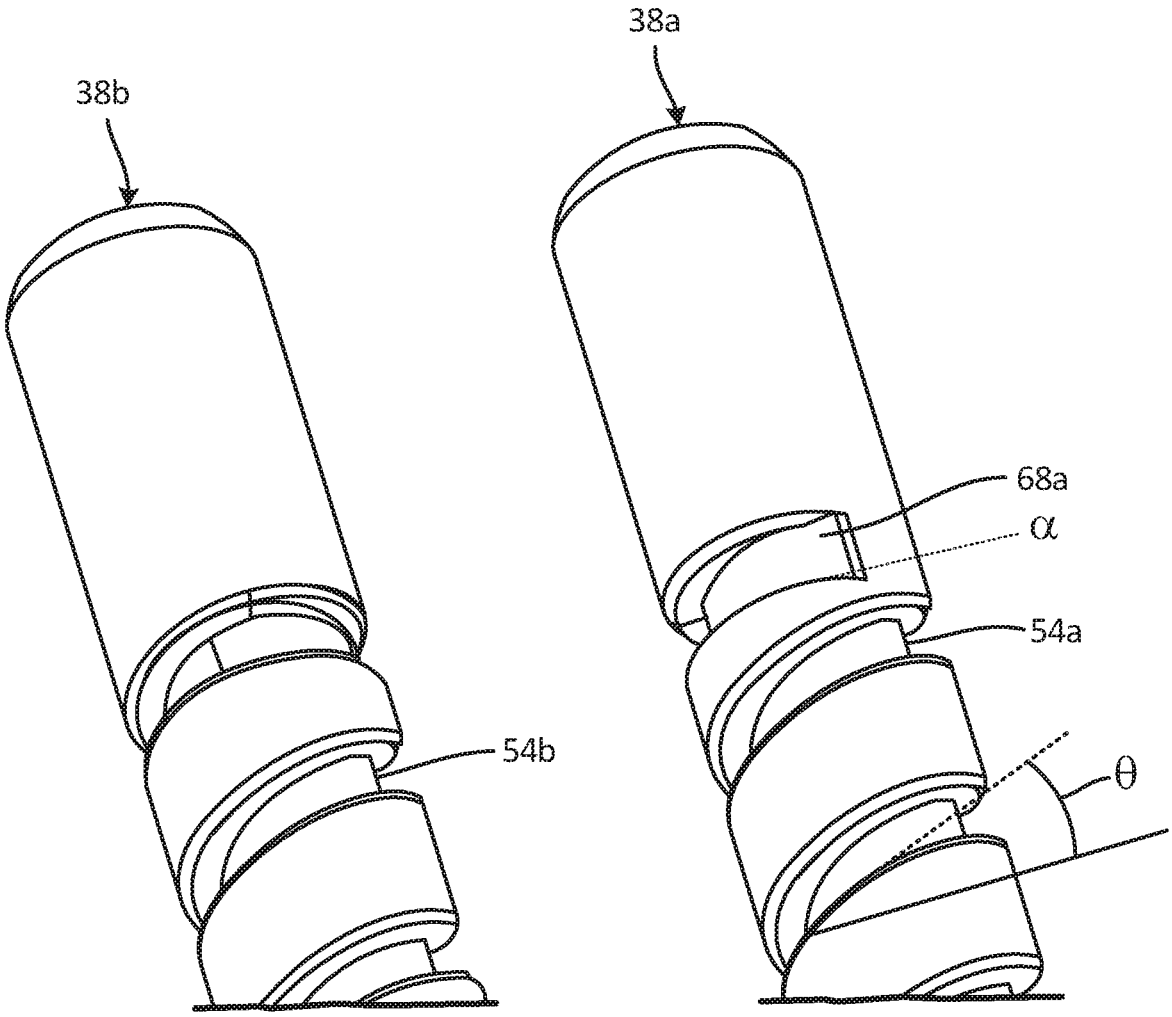
FIG. 4 is an enlarged view of detail Z of FIG. 3A.

FIG. 4 is a perspective view of detail Z of FIG. 3A. First screw 38*a* includes first thread 54*a*, and first thread 54*a* includes cam 68*a*. Second screw 38*b* includes second thread 54*b*, and second thread 54*b* similarly includes cam 68*b* (described in detail below and shown in FIGS. 5A-5B).

First thread 54*a* extends about first screw 38*a* and cam 68*a* is disposed at each end of first thread 54*a*. As first thread 54*a* approaches a terminal end the depth of first thread 54*a* decreases to form cam 68*a*. First thread 54*a* generally has a helix angle θ. The terminal ends of first thread 54*a*, including cam 68*a*, have a helix angle α that is smaller than the helix angle θ. Helix angle α is preferably about zero degrees such that cam 68*a* is generally perpendicular to a rotational axis of first screw 38*a*.

Second thread 54*b* extends about second screw 38*b*, and cam 68*b* is disposed at each end of second thread 54*b*. As second thread 54*b* approaches a terminal end of second thread 54*b*, the depth of second thread 54*b* decreases to form cam 68*b*. Similar to first thread 54*a*, second thread 54*b* generally has helix angle θ. The terminal ends of second thread 54*b*, including cam 68*b*, have a helix angle α that is smaller than the helix angle θ. Helix angle α is preferably about zero degrees such that cam 68*b* is generally perpendicular to a rotational axis of second screw 38*b*.

Providing a decreased helix angle α at the terminal end of first thread 54*a* and second thread 54*b* aligns shoe 48 during a changeover from engaging one of first screw 38*a* and second screw 38*b* to engaging the other one of first screw 38*a* and second screw 38*b*. As discussed below with regard to FIGS. 5A and 5B, first follower 64*a* is clocked relative to second follower 64*b* in one embodiment. To clock first follower 64*a* relative to second follower 64*a*, first follower 64*a* is rotated out of the same plane as second follower 64*b*. In one embodiment, first follower 64*a* is clocked about 10-15 degrees relative to second follower 64*b*. With first follower 64*a* clocked relative to second follower 64*b*, shoe 48 is prevented from changing over. The reduced helix angle α causes shoe 48 to rotate within traveling block 40 (best seen in FIGS. 3A-3C) and aligns shoe 48 to transition during a changeover. For example, as first follower 64*a* approaches the terminal end of first thread 54*a*, first follower 64*a* encounters cam 68*a*. Cam 68*a* pushes first follower 64*a* out of first thread 54*a*, and the reduced helix angle α causes shoe 48 to rotate as first follower 64*a* proceeds along cam 68*a*. Rotating shoe 48 aligns second follower 64*b* with second thread 54*b*, and second follower 64*b* transitions into and engages second thread 54*b*. With second follower 64*b* engaging second thread 54*b*, shoe 48 has completed the changeover and will be driven along second screw 38*b*. In some embodiments, first follower 64*a* is clocked by an amount equal to the helix angle θ. For example, where first follower 64*a* is clocked relative to second follower 64*b* by an amount equal to the helix angle θ, when first follower 64*a* is engaged with first thread 54*a*, second follower 64*b* will be disposed cross-wise to second thread 54*b* by an amount equal to twice the helix angle θ, preventing second follower 64*b* from falling into second thread 54*b*.

The reduced helix angle α at cam 68*a* and cam 68*b* also controls a dwell time of cable drum 26 (best seen in FIG. 2). The dwell time is the period of time where cable drum 26 rotates about the cable drum axis A-A (shown in FIG. 2) but does not translate along cable drum axis A-A. Where cam 68*a* and cam 68*b* are relatively short, the dwell time is correspondingly short. Where cam 68*a* and cam 68*b* are relatively longer, the dwell time is correspondingly longer.

Figure 5A:
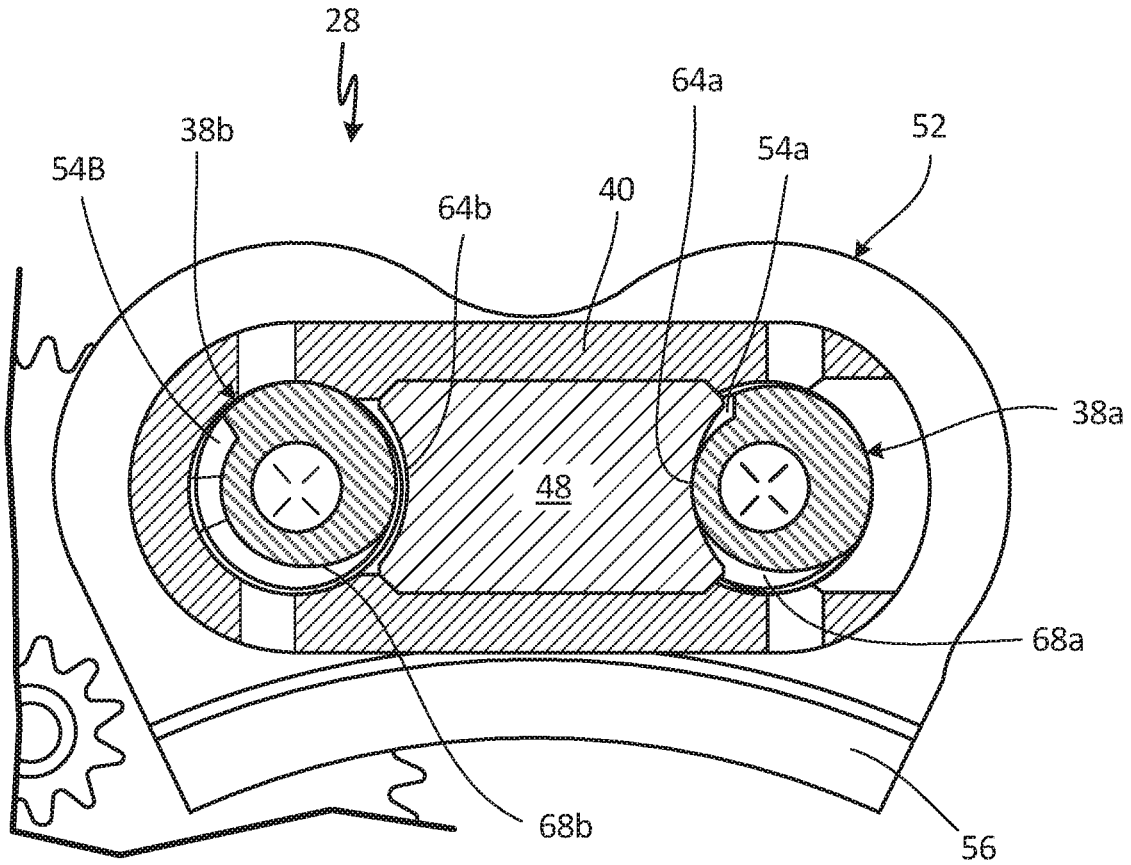
FIG. 5A is a cross-sectional view of the level wind mechanism of FIG. 2 taken along line 5-5 in FIG. 2 showing a shoe in a first position.
Figure 5B:
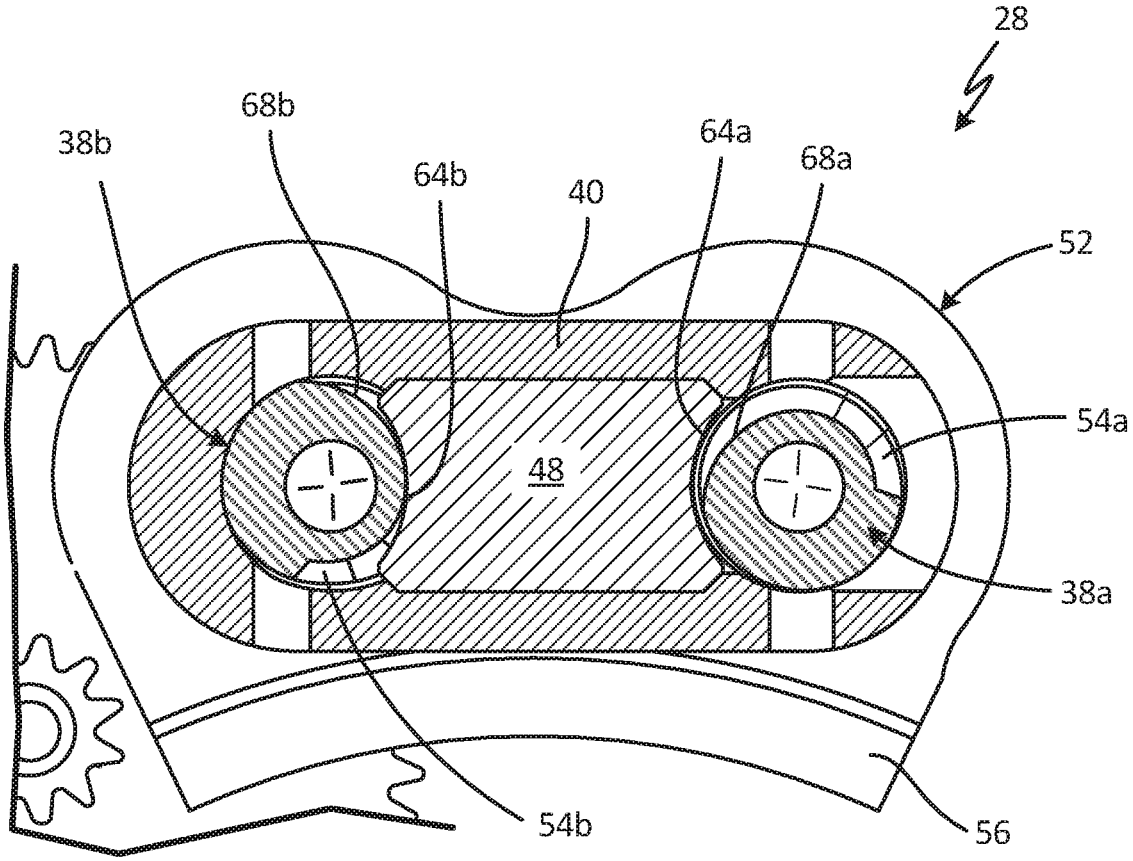
FIG. 5B is a cross-sectional view of the level wind mechanism of FIG. 2 taken along line 5-5 in FIG. 2 showing a shoe in a second position.

FIG. 5A is a cross-sectional view of level wind mechanism 28 taken along line 5-5 in FIG. 2 showing shoe 48 in a first position. FIG. 5B is a cross-sectional view of level wind mechanism 28 taken along line 5-5 in FIG. 2 showing shoe 48 in a second position. First screw 38*a*, second screw 38*b*, shoe 48, and mount 52 of level wind mechanism 28 are shown. First screw 38*a* includes first thread 54*a*, and first thread 54*a* includes cam 68*a*. Second screw 38*b* includes second thread 54*b*, and second thread 54*b* includes cam 68*b*. Shoe 48 includes first follower 64*a* and second follower 64*b*.

First screw 38*a* extends from mount 52 and extends through traveling block 40. Similarly, second screw 38*b* extends from mount 52 and extends through traveling block 40. First thread 54*a* extends about first screw 38*a*, and cam 68*a* is disposed at a terminal end of first thread 54*a*. Cam 68*a* is a decreasing depth of first thread 54*a* as first thread 54*a* reaches the terminal end. While cam 68*a* is shown at one terminal end of first thread 54*a*, it is understood that each terminal end of first thread 54*a* includes cam 68*a*. Second thread 54*b* extends about second screw 38*b*, and cam 68*b* is disposed at a terminal end of second thread 54*b*. Cam 68*b* is a decreasing depth of second thread 54*b* as second thread 54*b* reaches the terminal end. While cam 68*b* is shown at one terminal end of second thread 54*b*, it is understood that each terminal end of second thread 54*b* includes cam 68*b*.

Shoe 48 is disposed within traveling block 40 between first screw 38*a* and second screw 38*b*. First follower 64*a* extends from a first end of shoe body 66 and second follower 64*b* extends from a second end of shoe body 66 opposite the first end. First follower 64*a* is configured to engage with and be driven by first thread 54*a*. Similarly, second follower 64*b* is configured to engage with and be driven by second thread 54*b*.

During operation, first follower 64*a* tracks along first thread 54*a* until first follower 64*a* reaches cam 68*a*. When first follower 64*a* reaches cam 68*a*, cam 68*a* lifts first follower 64*a* out of first thread 54*a*, thereby causing shoe 48 to shift from engaging first screw 38*a* to engaging second screw 38*b*. Shifting shoe 48 causes second follower 64*b* to engage second thread 54*b*, and shoe 48 is then driven along second thread 54*b*. When second follower 64*b* reaches cam 68*b*, cam 68*b* lifts second follower 64*b* out of second thread 54*b*, thereby causing shoe 48 to shift from engaging second screw 38*b* to engaging first screw 38*a*. In this way, cam 68*a* and cam 68*b* ensure that shoe 48 translates between first screw 38*a* and second screw 38*b*, thereby driving cable drum 26 (best seen in FIG. 2) in a reciprocating manner.

Cam 68*a* causes shoe 48 to disengage from first screw 38*a* and displace to engage with second screw 38*b*. For example, in FIG. 5A, first follower 64*a* is disposed within first thread 54*a*. Where first screw 38*a* rotates in the clockwise direction second screw 38*b* preferably rotates in the counterclockwise direction. As first screw 38*a* rotates in the clockwise direction, first follower 64*a* tracks along first thread 54*a* and encounters cam 68*a*. Cam 68*a* lifts first follower 64*a* relative to first screw 38*a*, thereby causing shoe 48 to shift from the position shown in FIG. 5A to the position shown in FIG. 5B, with second follower 64*b* engaging second thread 54*b*. Second screw 38*b* then drives shoe 48 back along second screw 38*b* due to second screw 38*b* rotating in the opposite direction of first screw 38*a*.

Cam 68*b* causes shoe 48 to disengage from second screw 38 and displace to engage with first screw 38*a*. For example, in FIG. 5B, second follower 64*b* is disposed within second thread 54. Where second screw 38*b* rotates in the clockwise direction first screw 38*a* preferably rotates in the counterclockwise direction. As second screw 38*b* rotates in the clockwise direction, second follower 64*b* tracks along second thread 54*b* and encounters cam 68*b*. Cam 68*b* lifts second follower 64*b* relative to second screw 38*b*, thereby causing shoe 48 to shift from the position shown in FIG. 5B to the position shown in FIG. 5A, with first follower 64*a* engaging first thread 54*a*. First screw 38*a* then drives shoe 48 back along first screw 38*a* due to first screw 38*a* rotating in the opposite direction of second screw 38*b*.

It is understood that both ends of first thread 54*a* include cam 68*a*. In this way, both ends of first thread 54*a* are able to displace first follower 64*a* from first thread 54*a* to cause shoe 48 to change over to engaging second screw 38*b*. Similarly, both ends of second thread 54*b* include cam 68*b*, so both ends of second thread 54*b* are able to displace second follower 64*b* from second thread 54*b*, thereby causing shoe 48 to shift to engaging first screw 38*a*. As such, first screw 38*a* and second screw 38*b* are configured to affect the changeover of shoe 48 regardless of the direction of travel of shoe 48 and regardless of the direction of rotation of first screw 38*a* and second screw 38*b*.

Level wind mechanism 28 provides significant advantages. Each of first screw 38*a* and second screw 38*b* includes a single thread that causes shoe 48 to displace along first screw 38*a* and second screw 38*b*. The single thread prevents shoe 48 from prematurely reversing direction on first screw 38*a* or second screw 38*b*. Moreover, a single thread provides a more robust screw, thereby increasing the lifespan of the components of level wind mechanism 28.

Figure 6A:
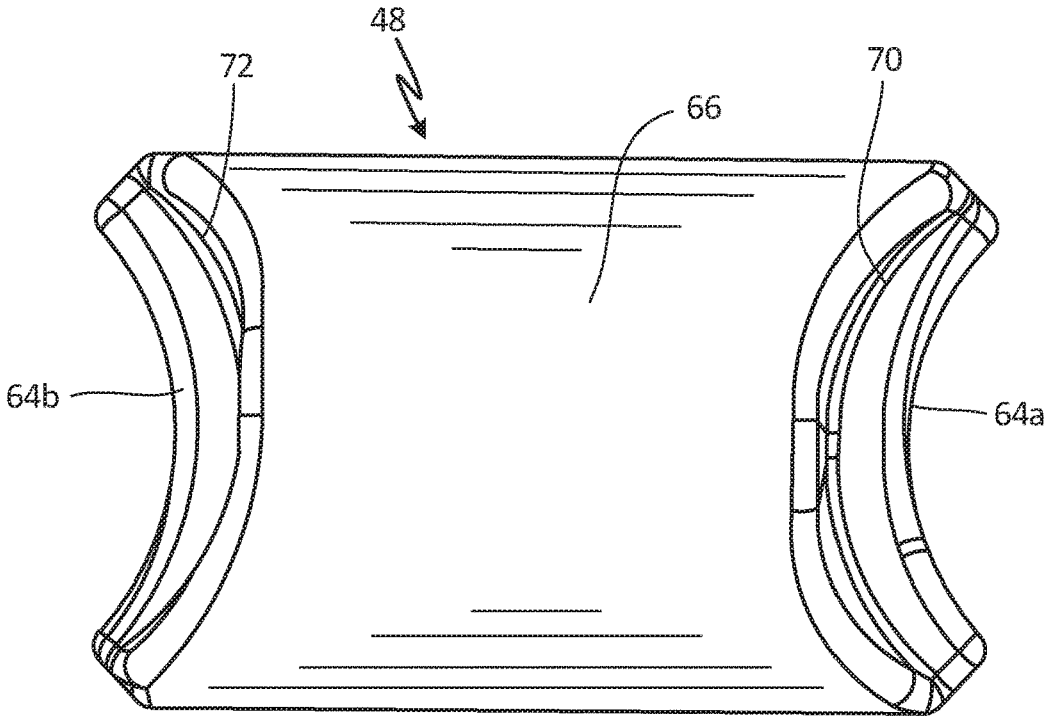
FIG. 6A is a side elevation view of a shoe.
Figure 6B:
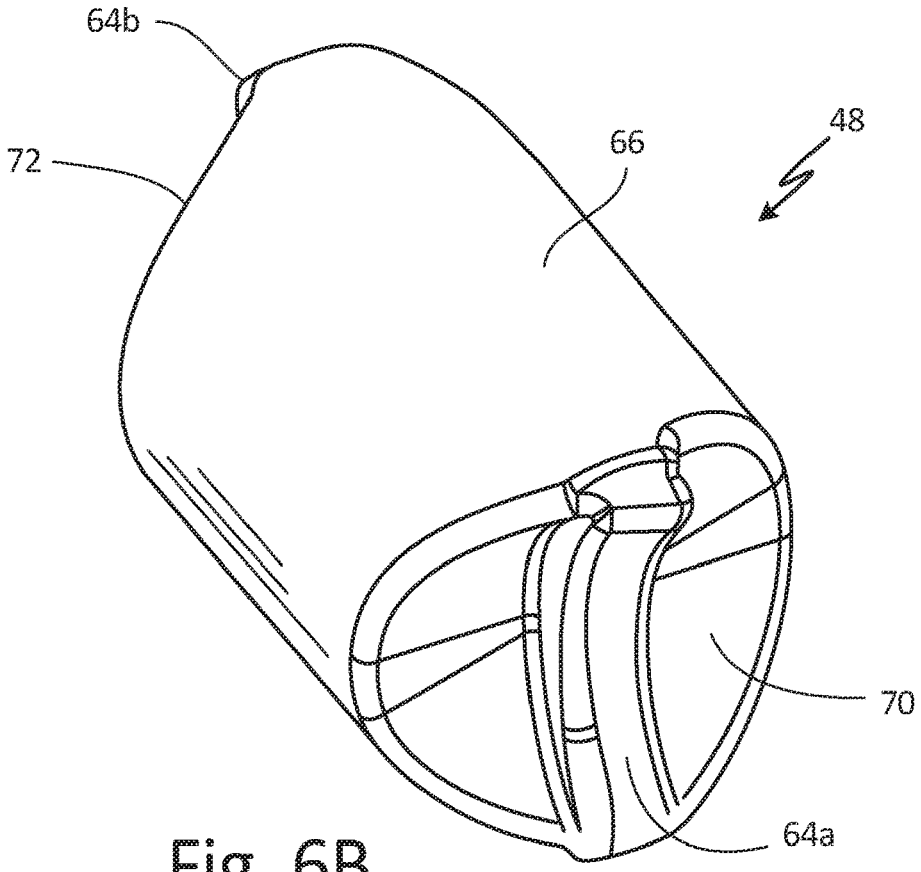
FIG. 6B is a perspective view of a shoe.

FIG. 6A is a side elevation view of shoe 48. FIG. 6B is a perspective view of shoe 48. FIGS. 6A and 6B will be discussed together. Shoe 48 includes shoe body 66, first end 70, and second end 72. First end 70 includes first follower 64*a*. Second end 72 includes second follower 64*b*.

First end 70 and second end 72 are arcuate. First end 70 is arcuate to match a contour of first screw 38*a*. Second end 72 is arcuate to match a contour of second screw 38*b*. First follower 64*a* extends from first end 70, and second follower 64*b* extends from second end 72. First follower 64*a* extends across a full diameter of first end 70. First follower 64*a* is helically curved to match the contour of first thread 54*a* (best seen in FIGS. 3A-3C). Curving first follower 64*a* provides a maximum contact area between first follower 64*a* and first screw 38*a*, thereby providing smoother, more efficient driving of first follower 64*a* within first thread 54*a*. Similarly, second follower 64*b* extends across a full diameter of second end 72, and second follower 64*b* is helically curved to match the contour of second thread 54*b* (best seen in FIGS. 3A-3C). Curving second follower 64*b* provides a maximum contact area between second follower 64*a* and second screw 38*b*, thereby providing smoother, more efficient driving of second follower 64*b* within second thread 54*b*. While first follower 64*a* and second follower 64*b* are described as being helically curved and as extending across a full diameter of shoe 48, it is understood that first follower 64*a* and second follower 64*b* can take any desired shape or size. For example, first follower 64*a* and second follower 64*b* can be a pin or head extending from first end 70 and second end 72, respectively. First follower 64*a* and second follower 64*b* can also be straight bars configured to fit into first thread 54*a* and second thread 54*b*, respectively.

First follower 64*a* is clocked relative to second follower 64*b* such that first follower 64*a* and second follower 64*b* are not on the same vertical plane passing through shoe 48. Clocking first follower 64*a* relative to second follower 64*b* helps prevent shoe 48 from prematurely shifting from engaging first screw 38*a* to engaging second screw 38*b*. By clocking first follower 64*a* relative to second follower 64*b*, second follower 64*b* is misaligned with second thread 54*b* and thus unable to fall into second thread 54*b* as first follower 64*a* tracks along first thread 54*a*. In this way, the clocking of first follower 64*a* and second follower 64*b* ensures that shoe 48 does not translate from first screw 38*a* to second screw 38*b* or from second screw 38*b* to first screw 38*a* prior to reaching the changeover point at the terminal ends of first thread 54*a* and second thread 54*b*.

Figure 7:
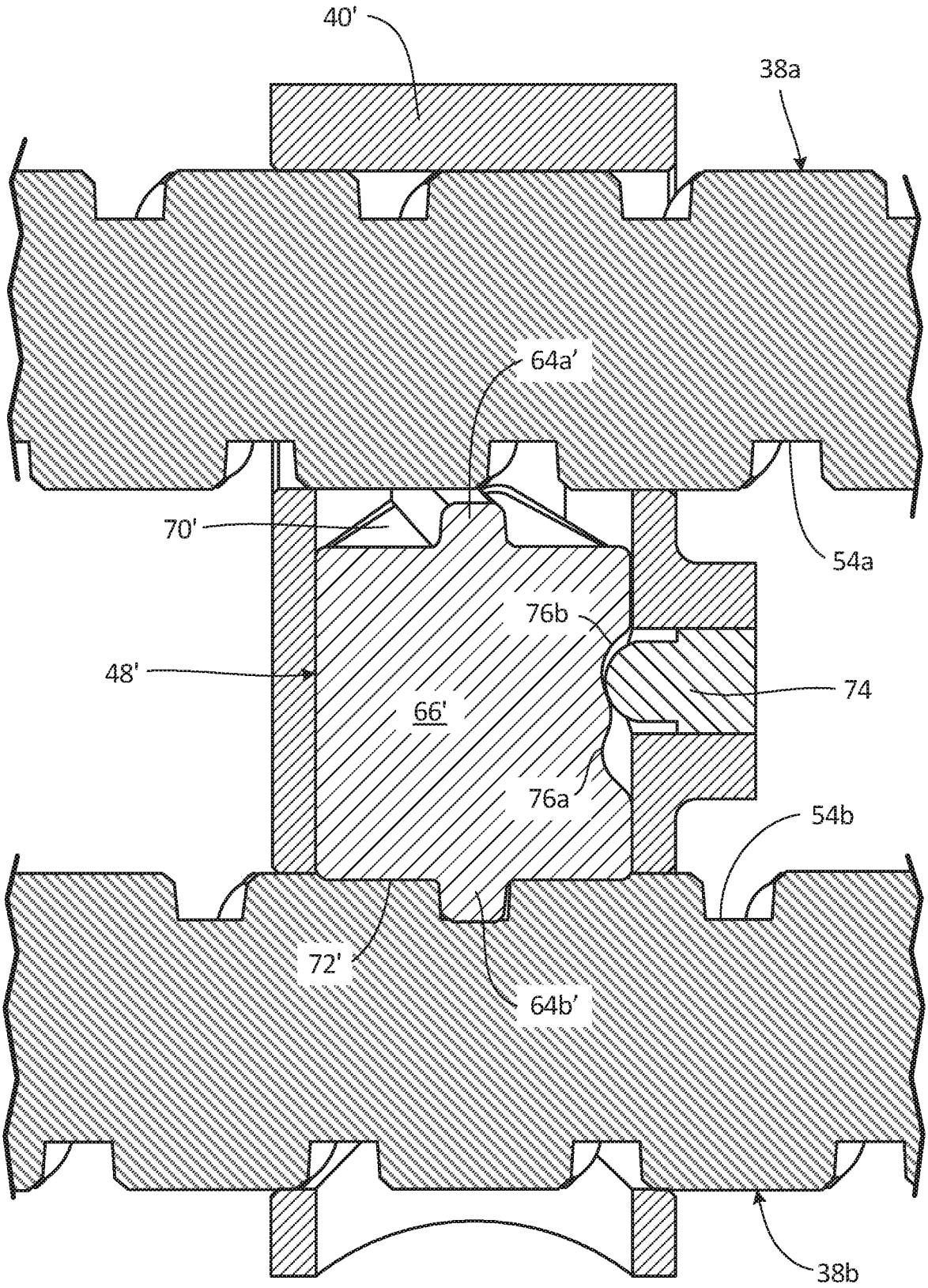
FIG. 7 is cross-sectional view of another embodiment of a level wind mechanism.

FIG. 7 is a cross-sectional view of level wind mechanism 28 having an alternate embodiment of shoe 48' and traveling block 40'. First screw 38*a* includes first thread 54*a*. Second screw 38*b* includes second thread 54*b*. Shoe 48' includes shoe body 66', first end 70', and second end 72'. First end 70' includes first follower 64*a*'. Second end 72' includes second follower 64*b*'. Shoe body 66' includes first depression 76*a* and second depression 76*b*. Traveling block 40' includes detent 74.

First thread 54*a* extends about first screw 38*a*, and first screw 38*a* extends through traveling block 40'. Second thread 54*b* extends about second screw 38*b*, and second screw 38*b* extends through traveling block 40'. Shoe 48' is disposed within traveling block 40' between first screw 38*a* and second screw 38*b*.

First end 70' of shoe 48' is arcuate to match the contour of first screw 38*a*. First follower 64*a*' extends from first end 70' and is configured to engage first thread 54*a*. Second end 72' of shoe 48' is arcuate to match the contour of second screw 38*b*. Second follower 64*b*' extends from second end 72' and is configured to engage second thread 54*b*. Shoe body 66' extends between and connects first end 70' and second end 72'. First depression 76*a* and second depression 76*b* extend into shoe body 66'. Detent 74 is retained by traveling block 40' and extends into traveling block 40' to alternatingly engage first depression 76*a* and second depression 76*b*. In one embodiment, detent 74 is of a spring and ball configuration, but it is understood that detent 74 can be any suitable device for resisting movement of shoe 48', such as spring steel or other spring-loaded pin.

During operation, first screw 38*a* and second screw 38*b* drive shoe 48' in a reciprocating manner. First follower 64*a*' engages first thread 54*a* and is driven along first thread 54*a* by the rotation of first screw 38*a*. Similarly, second follower

64*b*' engages second thread 54*b* and is driven along second thread 54*b* by the rotation of second screw 38*b*.

With first follower 64*a*' engaging first thread 54*a*, detent 74 is disposed in and engages first depression 76*a*. Detent 74 engaging first depression 76*a* maintains first follower 64*a*' in first thread 54*a* as first follower 64*a*' tracks along first thread 54*a*. As such, detent 74 prevents first follower 64*a*' from prematurely disengaging from first thread 54*a*, thereby preventing shoe 48' from prematurely changing over. When first follower 64*a*' reaches an end of first thread 54*a*, first thread 54*a* pushes first follower 64*a*' out of an engagement with first thread 54*a* and causes shoe 48' to shift within traveling block 40' until second follower 64*b*' engages second thread 54*b*. As shoe 48' shifts within traveling block 40', detent 74 is depressed by shoe 48', thereby allowing shoe 48' to transition to engaging second screw 38*b*. When second follower 64*b*' is engaged with second thread 54*b*, detent 74 snaps into place in second depression 76*b*. Detent 74 then maintains the position of shoe 48' such that second follower 64*b*' remains engaged with second thread 54*b* until a changeover of shoe 48' is desired. As such, detent 74 prevents shoe 48' from prematurely disengaged from first screw 38*a* or second screw 38*b*. Detent 74 thus allows first follower 64*a*' to be disposed in the same plane as second follower 64*b*' while still preventing any premature changeover. Detent 74 also reduces vibrations experienced by shoe 48' and by first screw 38*a* and second screw 38*b* by holding shoe 48' steady relative to first screw 38*a* and second screw 38*b*.

Discussion of Possible Embodiments

The following are non-exclusive descriptions of possible embodiments of the present invention.

A level wind mechanism includes a first screw, a second screw, a block through which the first screw and the second screw extend, and a shoe retained within the block between the first screw and the second screw. The first screw has a first driven end, a first distal end, and a first thread. The second screw has a second driven end, a second distal end, and a second thread. The shoe has a first follower extending from a first end of the shoe and a second follower extending from a second end of the shoe. The first follower is configured to engage with and be driven by the first thread and the second follower is configured to engage with and be driven by the second thread.

The level wind mechanism of the preceding paragraph can optionally include, additionally and/or alternatively, any one or more of the following features, configurations and/or additional components:

The first thread includes a first cam disposed at a first terminal end of the first thread and a second cam disposed at a second terminal end of the first thread.

The first thread has a first helix angle and the first cam has a second helix angle, the second helix angle is smaller than the first helix angle.

The second helix angle is about zero degrees.

A mount extending around and supporting the first driven end and the second driven end, a first drive gear attached to the first driven end, and a second drive gear attached to the second driven end.

The first drive gear is meshed with the second drive gear such that the first drive gear is configured to rotate opposite the second drive gear.

A first bearing disposed in the mount and supporting the first driven end, and a second bearing disposed in the mount and supporting the second driven end.

The first follower comprises a first curved ridge projecting from the first end of the shoe, and the second follower comprises a second curved ridge projecting from the second end of the shoe.

The first end is concavely curved and the second end is concavely curved.

The first thread has a first handedness and the second thread has a second handedness, and wherein the first handedness is the same as the second handedness.

A rescue hoist includes a cable drum rotatable about a cable drum axis, a linear bearing extending through and supporting the cable drum and configured to cause the cable drum to rotate about the cable drum axis, a stationary frame supporting the linear bearing, and a level wind mechanism configured to cause the cable drum to translate along the cable drum axis. The level wind mechanism includes a first screw, a second screw, a block through which the first screw and the second screw extend, and a shoe retained within the block between the first screw and the second screw. The first screw has a first driven end, a first distal end, and a first thread. The second screw has a second driven end, a second distal end, and a second thread. The block is mounted on an inner surface of the cable drum. The shoe has a first follower extending from a first end of the shoe and a second follower extending from a second end of the shoe. The first follower is configured to engage with and be driven by the first thread and the second follower is configured to engage with and be driven by the second thread.

The rescue hoist of the preceding paragraph can optionally include, additionally and/or alternatively, any one or more of the following features, configurations and/or additional components:

The first thread includes a first cam disposed at a first terminal end of the first thread and a second cam disposed at a second terminal end of the first thread.

The first thread has a first helix angle and the first cam has a second helix angle, wherein the second helix angle is smaller than the first helix angle.

The level wind mechanism includes a mount extending around and supporting the first driven end and the second driven end, the mount attached to the linear bearing such that the level wind mechanism rotates about the cable drum axis with the linear bearing and the cable drum.

A first drive gear attached to the first driven end, a second drive gear attached to the second driven end, and a main drive gear connected to and driving at least one of the first drive gear and the second drive gear.

The main drive gear includes an input gear meshing with teeth on the stationary frame.

The first drive gear meshes with the second drive gear.

The first follower comprises a first curved ridge projecting from the first end of the shoe, and the second follower comprises a second curved ridge projecting from the second end of the shoe.

The first end is concavely curved and the second end is concavely curved.

The first thread has a first handedness and the second thread has a second handedness, and wherein the first handedness is the same as the second handedness.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A level wind mechanism comprising:

a first screw including a first driven end, a first distal end, and a first thread, the first thread including a first cam disposed at a first terminal end of the first thread and a second cam disposed at a second terminal end of the first thread;

a second screw including a second driven end, a second distal end, and a second thread;

a block through which the first screw and the second screw extend; and a shoe retained within the block, the shoe having a first follower extending from a first end of the shoe and a second follower extending from a second end of the shoe, the first follower configured to engage with and be driven by the first thread and the second follower configured to engage with and be driven by the second thread;

wherein the first thread has a first helix angle and the first cam has a second helix angle, and wherein the second helix angle is smaller than the first helix angle.

2. The level wind mechanism of claim 1, wherein the second helix angle is zero degrees.

3. The level wind mechanism of claim 1, further comprising:

a mount extending around and supporting the first driven end and the second driven end;

a first drive gear attached to the first driven end; and a second drive gear attached to the second driven end.

4. The level wind mechanism of claim 3, wherein the first drive gear is meshed with the second drive gear such that the first drive gear is configured to rotate opposite the second drive gear.

5. The level wind mechanism of claim 3, further comprising:

a first bearing disposed in the mount and supporting the first driven end; and a second bearing disposed in the mount and supporting the second driven end.

6. The level wind mechanism of claim 1, wherein:

the first follower comprises a first curved ridge projecting from the first end of the shoe; and the second follower comprises a second curved ridge projecting from the second end of the shoe.

7. The level wind mechanism of claim 6, wherein the first end is concavely curved and the second end is concavely curved.

8. The level wind mechanism of claim 1, wherein the first thread has a first handedness and the second thread has a second handedness, and wherein the first handedness is the same as the second handedness.

9. A rescue hoist comprising:

a cable drum rotatable about a cable drum axis;

a linear bearing extending through and supporting the cable drum, the linear bearing configured to cause the cable drum to rotate about the cable drum axis;

a stationary frame supporting the linear bearing; and a level wind mechanism configured to cause the cable drum to translate along the cable drum axis, the level wind mechanism comprising:

a first screw including a first driven end, a first distal end, and a first thread, the first thread including a first cam disposed at a first terminal end of the first thread and a second cam disposed at a second terminal end of the first thread;

a second screw including a second driven end, a second distal end, and a second thread;

a block through which the first screw and the second screw extend, the block mounted on an inner surface of the cable drum; and a shoe retained within the block, the shoe having a first follower extending from a first end of the shoe and a second follower extending from a second end of the shoe, the first follower configured to engage with and be driven by the first thread thereby driving the shoe relative to the first screw and the second follower configured to engage with and be driven by the second thread thereby driving the shoe relative to the second screw; and wherein the first thread has a first helix angle and the first cam has a second helix angle, and wherein the second helix angle is smaller than the first helix angle.

10. The rescue hoist of claim 9, wherein the level wind mechanism further comprises:

a mount extending around and supporting the first driven end and the second driven end, the mount attached to the linear bearing such that the level wind mechanism rotates about the cable drum axis with the linear bearing and the cable drum.

11. The rescue hoist of claim 10, further comprising:

a first drive gear attached to the first driven end;

a second drive gear attached to the second driven end; and a main drive gear connected to and driving at least one of the first drive gear and the second drive gear.

12. The rescue hoist of claim 11, wherein the main drive gear includes an input gear meshing with teeth on the stationary frame.

13. The rescue hoist of claim 11, wherein the first drive gear meshes with the second drive gear.

14. The rescue hoist of claim 9, wherein:

the first follower comprises a first curved ridge projecting from the first end of the shoe; and the second follower comprises a second curved ridge projecting from the second end of the shoe.

15. The rescue hoist of claim 14, wherein the first end is concavely curved and the second end is concavely curved.

16. The rescue hoist of claim 9, wherein the first thread has a first handedness and the second thread has a second handedness, and wherein the first handedness is the same as the second handedness.

* * * * *